US006024537A

United States Patent [19]

Moreau et al.

[11] Patent Number: 6,024,537

[45] Date of Patent: Feb. 15, 2000

[54] AXIAL FLOW FAN

[75] Inventors: Stéphane Moreau, Paris, France; Norman G. Golm, Rochester Hills, Mich.

[73] Assignee: Valeo Engine Cooling, Inc., Rochester Hills, Mich.

[21] Appl. No.: 08/902,295

[22] Filed: Jul. 29, 1997

[51] Int. Cl.[7] ..... F04D 29/38

[52] U.S. Cl. ..... 416/192; 416/169 A; 416/235; 416/238

[58] Field of Search ..... 415/173.5, 173.6; 416/191, 192, 169 A, 238, 235, 237

[56] References Cited

U.S. PATENT DOCUMENTS

| | | | |
|---|---|---|---|
| 1,041,912 | 10/1912 | Tyson | 416/237 |
| 1,117,103 | 11/1914 | Steinbach | 416/235 |
| 1,247,263 | 11/1917 | Grindle | 416/235 |
| 4,566,852 | 1/1986 | Hauser | 415/182 |
| 4,757,587 | 7/1988 | Choi | 416/236 A |
| 5,730,583 | 3/1998 | Alizadeh | 416/238 |

*Primary Examiner*—Edward K. Look
*Assistant Examiner*—Richard Woo
*Attorney, Agent, or Firm*—Morgan & Finnegan, L.L.P.

[57] ABSTRACT

A fan module with an axial flow fan and a shroud member. The axial flow fan has a hub and a plurality of fan blades, each blade extending radially from the hub. At the tips of the blades are air guide members secured to respective fan blades and concentric with the hub. Each air guide member has an axially-extending arcuate portion, and a respective lip portion extending radially outwardly from each said arcuate portion. The axially-extending portion has an axial length substantially equal to or less than the axial length of said hub. The shroud member has a surface cooperating with the air guide members in an arrangement to reduce tip vortices.

15 Claims, 3 Drawing Sheets

AXIAL FLOW FAN

The present invention relates to axial flow fans and particularly but not exclusively to such fans which are suitable for causing air to flow through a heat exchanger in a vehicle.

BACKGROUND OF THE INVENTION

In operation such fans may be used to blow, or alternatively draw, air through a heat exchanger such as a radiator. In either case it is desirable to provide a high efficiency fan to avoid waste of energy.

One source of energy loss during operation of axial flow fans is the so-called "re-flux" of air around the axial periphery of the fan caused by air flowing from the high pressure side of the fan to the lower pressure side. This air flow is also known as a tip vortex and is not useful because the fan is using energy to create air flow which does not flow through the heat exchanger. Moreover this air flow creates noise which is itself both inefficient and can also be intrusive and unpleasant.

Many solutions have been proposed for the solution of these problems. For example in U.S. Pat. No. 4,566,852 (Hauser) a cooling arrangement using an axial flow fan is provided which improves the efficiency of the fan and reduces noise level during operation. This is achieved by providing an air guide structure in the form of a ring attached to the fan blades which cooperates with a non-rotating fan frame (or shroud) so that the contours of the air guide conforms closely to the facing contour of the shroud thereby providing a constricted path for re-flux air flow to reduce it. Additionally the re-flux air flow (known in that reference as "slot air flow") is strongly throttled as a result of the shape of the air guide and its close cooperation with the shroud, and this leads to a reduction in noise.

However in such an arrangement the additional mass of the rotating ring may create mechanical stress. In addition the provision of the rotating ring increases material costs in manufacturing the fan.

OBJECT AND SUMMARY OF THE INVENTION

It is therefore an object of the invention to at least partly mitigate the above difficulties.

Accordingly an aim of certain embodiments of the present invention is to provide an axial flow fan having air flow properties comparable to a fan having a rotating ring whilst reducing weight and rotating mass. Thereby mechanical stresses and material costs during the manufacturing process may be reduced.

Accordingly one aspect of the present invention provides an axial flow fan comprising a hub member having a longitudinal axis, a plurality of fan blade members, each fan blade member having a root and a tip, each said root being secured to said hub member, whereby said fan blade members extend radially from said hub member, and a corresponding plurality of axially-extending members, each axially-extending member comprising an arcuate portion disposed at the tip of a respective fan blade member and concentric with said hub member.

Advantageously the arcuate axially-extending members are part-circular.

Conveniently each axially-extending member is secured to the corresponding blade at a location between 95% and 100% of the span of each blade.

Preferably said location is at the tip of said blade.

Advantageously the axially-extending members have a respective lip portion extending radially outwards therefrom.

Conveniently the axial length of said axially-extending member is equal to or less than the axial length of said hub member.

Advantageously each axially-extending member subtends at said axis an angle of between 80% and 120% of the angle subtended by each blade tip.

Preferably the lip portion has a radially outward extent greater than about 2% of the radial extent of the extremity of the tip.

Conveniently the lip portion of each axially-extending member has a leading edge disposed at an angle of between 20° and 90° to a direction of rotation.

Advantageously an axial flow fan comprises a hub portion and plural blade members, each of said plural blade members having a root, the root being secured to and extending from the hub portion, each of said plural blade members further having a tip radially remote from the hub portion, and a respective tip-vortex reduction member secured to each blade.

Conveniently the tip-vortex reduction member is secured to said blade near the tip of said blade.

Preferably the axial flow fan has an axis of rotation and each said tip-vortex reduction member comprises a part-circular portion extending axially from said tip, said part-circular portion being concentric with said hub member, and further comprises a lip portion extending radially outwards from said part-circular portion.

Conveniently the lip portion extends from an axial extremity of said arcuate portion.

In accordance with another aspect of the invention there is provided an axial flow fan comprising a hub having a longitudinal axis, a plurality of fan blades, each fan blade having a root and a tip, each said root being secured to said hub, whereby said fan blade members extend radially therefrom, and each blade being shaped to cause air to flow in a predetermined direction when said fan is rotated in a given direction; and a corresponding plurality of axially-extending members, each having an axial length substantially equal to or less than the axial length of said hub member secured to a respective blade member.

Advantageously each axially-extending member has a lip portion extending radially outwardly therefrom, said lip portion having a leading edge disposed at an angle to a direction of rotation.

In accordance with a further aspect of the invention there is provided an axial flow fan comprising a hub having a longitudinal axis, a plurality of fan blades, each having a root and a tip, each said root being secured to said hub for rotation therewith, whereby said fan blade members extend radially therefrom, and an air guide structure concentric with said hub member, wherein said guide structure extends from each fan blade member, and comprises a plurality of spaced elements and the circular path.

In accordance with another aspect of the present invention there is provided a fan module comprising an axial flow fan and a shroud member, said axial flow fan comprising a hub having a longitudinal axis, a plurality of fan blades, each fan blades having a root and a tip, each said root being secured to said hub, whereby said fan blades extend outwardly from said hub, and a corresponding plurality of spaced air guide members, each air guide member having a part-circular portion secured to a respective fan blade and concentric with said hub member, and said shroud member having a surface cooperating with said axially-extending members, whereby tip vortices are, in use, reduced.

Advantageously the air guide members the fan module of claim 16 wherein said air guide members have an outwardly directed lip and said shroud member co-operates with said lips or said air guide members.

In accordance with a still further aspect of the invention there is provided a fan module comprising an axial flow fan and a shroud member, said axial flow fan comprising a hub member having a longitudinal axis, a plurality of fan blade members each fan blade member having a root and a tip each said root being secured to said hub member, whereby said fan blade members extend radially from said hub member, and a corresponding plurality of axially-extending members, each axially-extending member comprising an arcuate portion disposed at the tip of a respective fan blade member and concentric with said hub member, and a respective lip portion extending radially outwardly from each said arcuate portion.

Preferred embodiments of the present invention will now be described hereinbelow by way of example only with reference to the accompanying drawings in which:

DESCRIPTION OF THE PREFERRED EMBODIMENT

Figure 1:
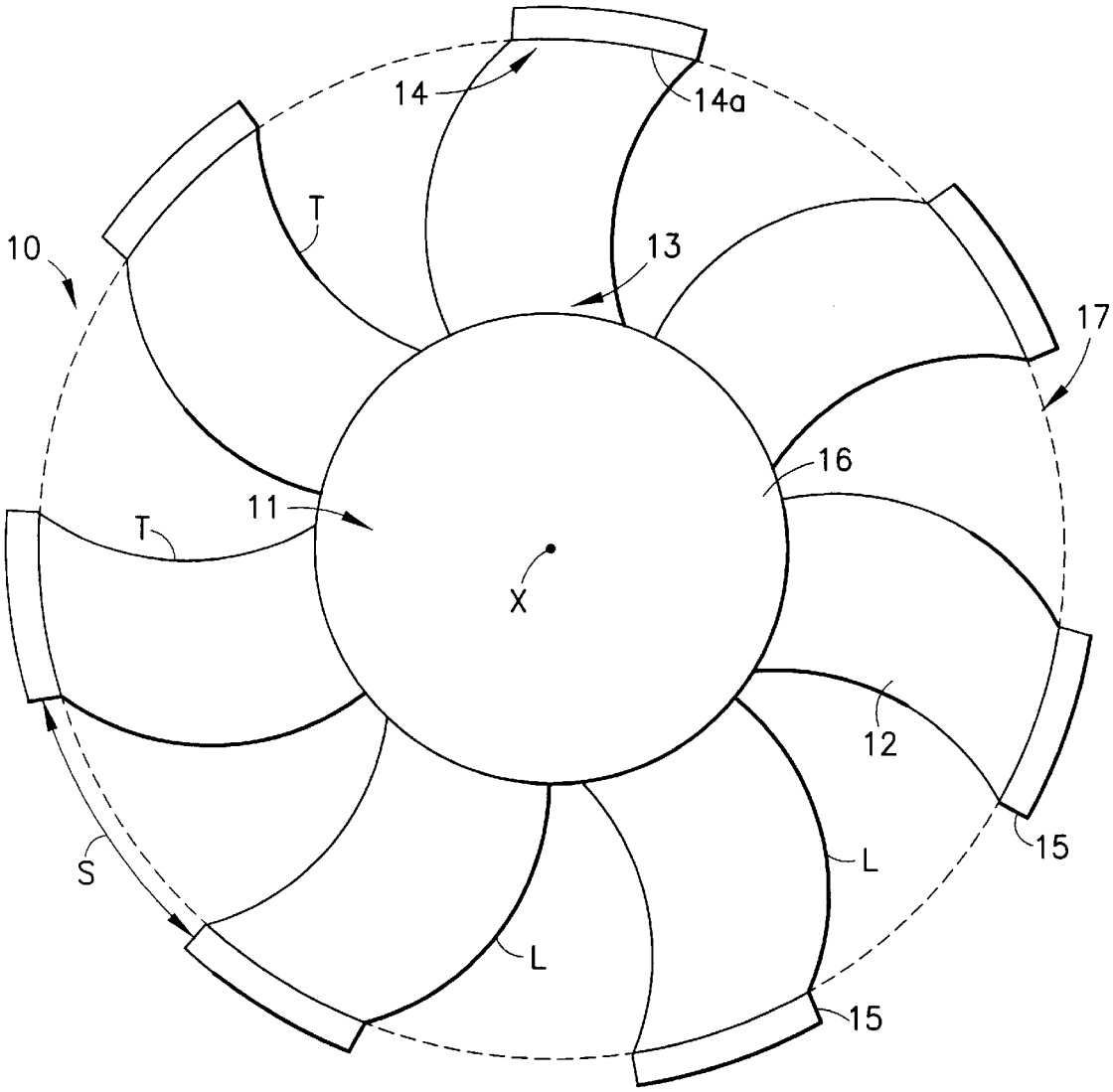
FIG. 1 shows a projection onto a plane perpendicular to the rotational axis of a first embodiment of an axial flow fan in accordance with the invention.

In the various Figures, like reference numerals refer to like parts.

Referring to FIG. 1 an axial flow fan 10 has a moulded plastics hub member 11 having a central longitudinal axis X. The hub member 11 is generally bowl-shaped (as can better be seen in FIG. 2) and has a forwardly domed front portion 16 and a cylindrical rear portion 24 which defines a hub circle.

Seven moulded plastic fan blades 12 are secured to the hub member 11 and extend radially outwardly therefrom. (It will of course be understood that the number of blades will be selected according to the application). Each of the fan blades 12 has a root region 13 radially proximate to the hub member and a tip region 14 radially remote from said hub member.

As is known to those skilled in the art, fans are designed for a particular direction of rotation and the fan of FIG. 1 rotates in the anti-clockwise direction R. It is possible for the blades to be un-skewed in the sense that a medial line of each blade is disposed on a radius of the fan, or for the blades to be forwardly skewed, in which case the medial line in the tip region is disposed circumferentially ahead of the medial line in the root region, or, as shown in FIG. 1, for the blade to be rearwardly skewed whereby the medial line M in the tip region is located at a position M1 which is behind the position of the medial line in the root region M2 with respect to the direction of rotation R. The pitch of each blade will be chosen according to the required application.

Each blade has a blade leading edge L and a blade trailing edge T, the leading and trailing edges being curved in the same sense so that the blade has a generally constant width. (Once again the feature of constant width is a matter of design which depends on the application. Where appropriate other geometries are possible).

The root region 13 of each blade is secured to the hub member over the whole of the width of the blade 12 thereby providing mechanical strength and rigidity for the fan.

The radially outermost end of the tip region 14 of each fan blade forms a respective distal region 14*a*. As may better be seen from the projection shown in FIG. 1 the distal region of each blade is arcuate in shape and lies on a tip circle 17 concentric with the hub circle defined by the cylindrical rear portion of the hub member.

Moulded plastic winglets forming air guide portions 15 extend from the distal region 14*a* of each fan blade 12, one winglet to each blade. Each air guide portion has an axial extent substantially equal to or less than the axial length of the fan hub member, and a circumferential extent substantially equal to the width of the blade 12 in the tip region. Thus the winglets are spaced around the periphery of the fan.

Figure 3:
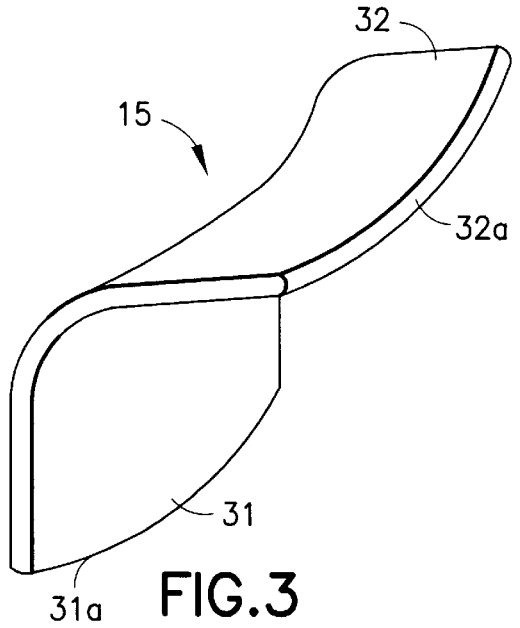
FIG. 3 shows an air guide member of the fan of FIG. 1 suitable for reducing tip vortices.

FIG. 3 shows one of the air guide portions 15 of FIG. 1. Each air guide has a part-circular, axially extending wall portion 31 concentric with the hub circle and lying on the tip circle 17.

Towards the front of the fan the arcuate wall portion 31 curves outwardly through substantially 90° to form a lip portion 32 with an outer edge 32*a* defining an arc of a circle concentric with the fan. In other embodiments there may be no lip, so that the arcuate wall portion is substantially a part cylinder, or the lip may be disposed at an angle to the plane of the blade.

Thus each fan blade carries an air guide portion 15, and each air guide portion 15 is spaced from the nearest adjacent air guide portions by a circumferential spacing S around the tip circle 17. Each air guide portion accordingly has an air guide portion leading edge and an air guide portion trailing edge.

Figure 2:
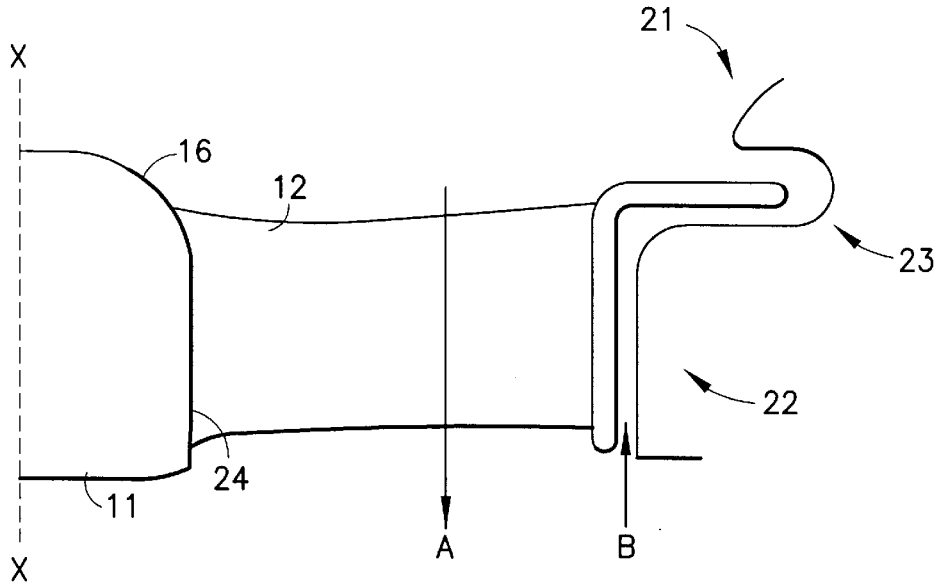
FIG. 2 shows a partial cross-section view through the fan of FIG. 1.

Referring further to FIG. 2 a partial cross-section through the fan 10 of FIG. 1 is shown together with an associated shroud member 21.

The shroud member 21 provides a rigid, non-rotating frame within which the fan 10 revolves. The shroud member has a circular-cylindrical portion 22 which is disposed radially outwardly of and proximate to the circular wall portion 31 of each air guide portion 15. The shroud member 21 also has a radially outwardly recessed portion 23 which harbours and is proximate to at least a part of the lip portion 32 of each air guide portion 15. In other embodiments, where no lip is provided the shroud may have no recessed portion.

In operation the rotation of the fan 10 draws air from the front of the fan through to the rear of the fan in the direction shown by arrow A. The air pressure immediately at the front and rear of the fan will be such that there is a tendency for re-flux air to move between the fan periphery and the shroud member in the direction shown by the arrow B.

The shape of the air guide portions 15 in cooperation with the proximate portions (22,23) of the shroud member 21 shown in FIG. 2 provides a narrow serpentine path to prevent re-flux air flow from the high pressure side of the fan to the low pressure side. The spacing between the air guide portion and the shroud is as narrow as possible, having due regard to manufacturing and operating tolerances, so as to minimise the volume through which air can flow around the fan periphery.

Figure 4:
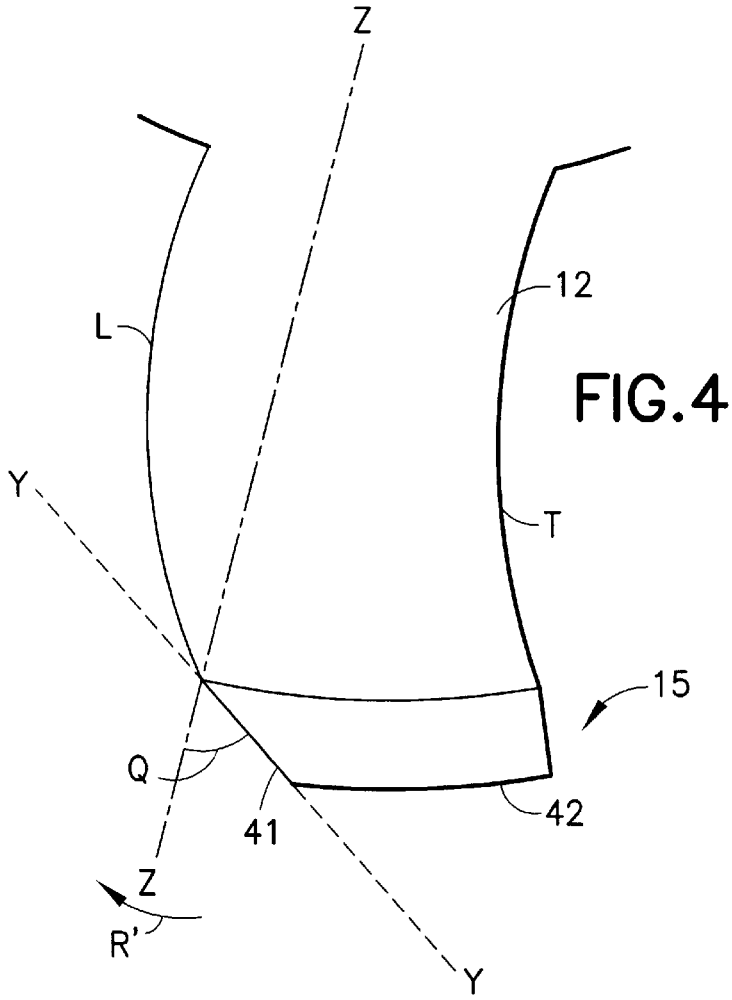
FIG. 4 shows a plan view of part of a second embodiment of the invention showing an air guide member having an angled leading edge.

FIG. 4 shows a plan view of one of the fan blades 12 of a second embodiment of a fan in accordance with the invention.

Figure 5:
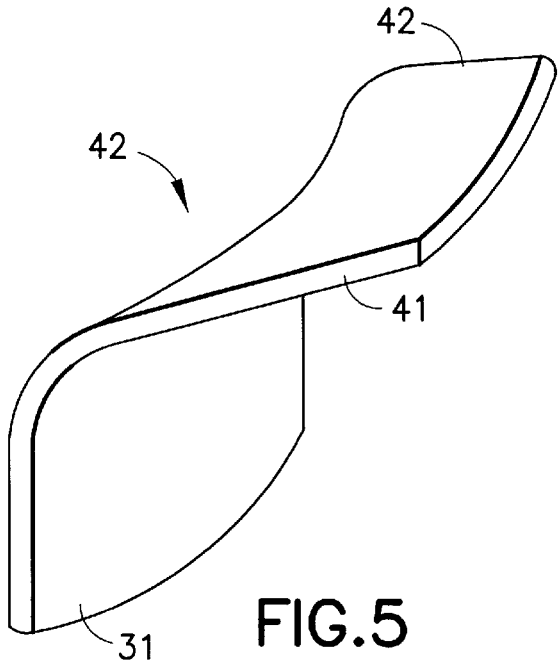
FIG. 5 shows a view similar to FIG. 3, of the air guide member of FIG. 4.

Referring to FIGS. 4 and 5, the air guide portion 42 of this embodiment is similar to that of the first embodiment, in that it has a part-circular, axially extending wall portion 31, and a lip portion 42.

The lip portion 42 has a leading edge 41 which corresponds to the leading edge of the blade 12. As may better be seen from the view of FIG. 4 the edge 41 lies on a line Y—Y at an angle θ to a radial line Z—Z which passes through the hub axis X and the point 43 where the leading edge L and the distal region 14*a* coincide.

The leading edge of the lip portion of each air guide portion set at an angle θ between 0° and 70° to the radial line Z—Z results in a more efficient fan having better aerodynamic properties and a reduced noise output.

Although the described embodiments have one winglet per blade, it would be possible to provide plural smaller winglets, for example, two per blade, and it would also be possible to provide winglets on only some of the blades. The winglets of the described embodiments are part-circular, but other arcuate shapes would also be possible if desired.

The fan of the embodiment is of moulded plastics material. Other materials or other manufacturing techniques could be used.

Whilst several preferred embodiments are shown in accordance with the invention it should be understood that the same is not so limited and that modifications as would be known by those skilled in the art may be envisaged without departing from the scope of the invention.

For example whilst the air guide portions described hereinabove have an arcuate wall portion and lip portion which extend circumferentially along substantially the whole width of the blade it is envisaged that various other shapes and sizes of air guide portions could be used.

We claim:

1. A fan module comprising:

an axial flow fan comprising:

a hub having a longitudinal axis, a plurality of fan blades, each fan blade having a root and a tip, each said root being secured to said hub, said fan blade members extending radially from said hub; and a corresponding plurality of arcuate axially-extending members, each axially-extending member being secured to a respective fan blade, wherein each said axially-extending member has a respective lip portion extending radially outwards therefrom; and a shroud member having a surface cooperating with said axially-extending members in an arrangement to reduce tip vortices.

2. The axial flow fan of claim 1 wherein said arcuate axially-extending members are part-circular.

3. The axial flow fan of claim 1 wherein each said axially-extending member is secured to the corresponding blade over at least 95% of the span of each blade.

4. The axial flow fan of claim 3 wherein each said axially-extending member is secured at the tip of the corresponding blade.

5. The axial flow fan of claim 5 wherein said lip portion has a radial extent greater than 2% of the blade radius.

6. The axial flow fan of claim 1 wherein said fan is adapted to rotate in a predetermined direction and the lip portion of each axially-extending member has a leading edge disposed at an angle of between 20° and 90° to said direction of rotation.

7. The axial flow fan of claim 1 wherein the axial length of said axially-extending member is equal to or less than the axial length of said hub.

8. The axial flow fan of claim 1 wherein each axially-extending member subtends an angle of between 80% and 120% of the angle subtended by each blade tip.

9. An axial flow fan comprising a hub portion and a plurality of blades, each of said blades having a root, each said root being secured to the hub portion, each of said blades further having a tip radially remote from the hub portion, a respective tip-vortex reduction member secured to each blade;

wherein said fan has an axis of rotation and each said tip-vortex reduction member comprises a part-circular portion extending axially from said blade, said part-circular portion being concentric with said hub, and further comprises a lip portion extending radially outwards from said part-circular portion in a direction substantially away from said hub.

10. The axial flow fan of claim 9 wherein each said tip-vortex reduction member is secured to a respective blade near the tip of said blade.

11. The axial flow fan of claim 9 wherein said lip portion extends from an axial extremity of said part-circular portion.

12. A fan module comprising:

an axial flow fan comprising:

a hub having a longitudinal axis;

a plurality of fan blades, each fan blade having a root and a tip, each said root being secured to said hub, said fan blade members extending radially therefrom, and each blade being shaped to cause air to flow in a predetermined direction when said fan is rotated in a given direction; and a corresponding plurality of arcuate axially-extending members, each having an axial length substantially equal to or less than the axial length of said hub secured to a respective blade member, wherein each said axially-extending member has a respective lip portion extending radially outwards therefrom; and a shroud member having a surface cooperating with said axially-extending members in an arrangement to reduce tip vortices.

13. A fan module comprising:

an axial flow fan comprising:

a hub having a longitudinal axis, a plurality of fan blades, each having a root and a tip, each said root being secured to said hub for rotation therewith, said fan blade members extending radially therefrom, and an air guide structure concentric with said hub, wherein said guide structure extends from each fan blade member, and comprises a plurality of spaced elements around a circular path, wherein each said spaced element has a respective lip portion extending radially outwards therefrom; and a shroud member having a surface cooperating with said spaced elements of said air guide structure in an arrangement to reduce tip vortices.

14. A fan module comprising:

a shroud member; and an axial flow fan comprising:

a hub having a longitudinal axis, a plurality of fan blades, each fan blade having a root and a tip and configured to blow air consequent to rotation of the fan, each said root being secured to said hub, said fan blades extending outwardly from said hub, and a corresponding plurality of spaced air guide members, each air guide member having a part-circular portion secured to a respective fan blade and concentric with said hub, wherein each said part-circular portion has a respective lip portion extending radially outwards therefrom, and said shroud member having a surface cooperating with said air guide members in an arrangement to reduce tip vortices.

15. A fan module comprising:

a shroud member cooperating with an axial flow fan; and said axial flow fan comprising:

a hub having a longitudinal axis, a plurality of fan blade members each fan blade member having a root and a tip, each said root being secured to said hub, said fan blade members extending radially from said hub, and a corresponding plurality of axially-extending members, each axially-extending member comprising an arcuate portion disposed at the tip of a respective fan blade member and concentric with said hub, and a respective lip portion extending radially outwardly from each said arcuate portion in a direction substantially away from said hub.

* * * * *

UNITED STATES PATENT AND TRADEMARK OFFICE

CERTIFICATE OF CORRECTION

PATENT NO. : 6,024,537

DATED : February 15, 2000

INVENTOR(S) : Moreau, et. al.

It is certified that error appears in the above-identified patent and that said Letters Patent is hereby corrected as shown below:

At Column 6, line 9 delete 5 and insert 1 .

Signed and Sealed this

Sixth Day of February, 2001

*Attest:*

*Attesting Officer*

Q. TODD DICKINSON

*Director of Patents and Trademarks*